US011260425B2

(12) United States Patent
Watanabe et al.

(10) Patent No.: US 11,260,425 B2
(45) Date of Patent: Mar. 1, 2022

(54) CASTING SAND RECLAMATION SYSTEM AND CASTING SAND RECLAMATION METHOD

(71) Applicant: Taiyo Machinery Co., Ltd., Osaka (JP)

(72) Inventors: Kenzo Watanabe, Osaka (JP); Akitoshi Inoue, Osaka (JP)

(73) Assignee: Taiyo Machinery Co., Ltd., Osaka (JP)

( * ) Notice: Subject to any disclaimer, the term of this patent is extended or adjusted under 35 U.S.C. 154(b) by 0 days.

(21) Appl. No.: 17/058,641

(22) PCT Filed: Mar. 26, 2020

(86) PCT No.: PCT/JP2020/013652
§ 371 (c)(1),
(2) Date: Nov. 24, 2020

(87) PCT Pub. No.: WO2020/196748
PCT Pub. Date: Oct. 1, 2020

(65) Prior Publication Data

US 2021/0205851 A1 Jul. 8, 2021

(30) Foreign Application Priority Data

Mar. 28, 2019 (JP) ..... JP2019-064128

(51) Int. Cl.

| | |
|---|---|
| ***B07B 11/04*** | (2006.01) |
| ***B07B 4/02*** | (2006.01) |
| ***B07B 11/02*** | (2006.01) |
| ***B22C 5/04*** | (2006.01) |

(Continued)

(52) U.S. Cl.
CPC ..... *B07B 11/04* (2013.01); *B07B 4/02* (2013.01); *B07B 11/02* (2013.01); *B22C 5/04* (2013.01); *B22C 5/10* (2013.01); *B22C 5/18* (2013.01)

(58) Field of Classification Search
CPC ..... B07B 11/02; B07B 11/04; B07B 4/02; B07B 4/08; B07B 13/16; B07B 13/18; B22C 5/04; B22C 5/10; B22C 5/18
(Continued)

(56) References Cited

U.S. PATENT DOCUMENTS 2,821,375 A * 1/1958 Andrews ..... B22C 5/18 432/44
4,436,138 A * 3/1984 Kondo ..... B02C 19/0031 164/412

(Continued)

FOREIGN PATENT DOCUMENTS

JP 59-169644 9/1984
JP 06-154941 6/1994

(Continued)

OTHER PUBLICATIONS

International Search Report (with English translation) and Written Opinion, counterpart International App. No. PCT/JP2020/013652 (dated Jun. 23, 2020) (8 pages).

*Primary Examiner* — Gene O Crawford
*Assistant Examiner* — Muhammad Awais
(74) *Attorney, Agent, or Firm* — Cook Alex Ltd.

(57) ABSTRACT

In a casting sand reclamation system and a casting sand reclamation method, an appropriate reclamation process is performed according to the properties of casting sand to improve the reclamation accuracy and the reclamation yield. Capacitance measuring devices 70 and 71 that measure the capacitance of casting sand 1 (recovered sand 1*a* or reclamation sand 1*b*) are arranged on an upstream side and a downstream side of a batch-type polishing device 7, and feedback control is performed based on the measurement results of the capacitances by these capacitance measuring devices 70 and 71. A sorting device 10 sorts the recovered sand 1*a* polished by the polishing device 7 into a sand grain (Continued)

component (reclamation sand) and a fine grain component (containing a binder), and has a capacity N times that of the polishing device 7. A control device 80 performs feedback control based on capacitance RU of the recovered sand 1*a* measured for each polishing process on an upstream side of the polishing device 7, and an average value of N capacitances RD of the reclamation sand 1*b* measured for each polishing process on a downstream side of the sorting device 10.

8 Claims, 10 Drawing Sheets

(51) Int. Cl.
*B22C 5/10* (2006.01)
*B22C 5/18* (2006.01)

(58) Field of Classification Search
USPC ..... 209/3
See application file for complete search history.

(56) References Cited

U.S. PATENT DOCUMENTS

| | | | | |
|---|---|---|---|---|
| 4,681,267 | A * | 7/1987 | Leidel | B22C 5/08 164/412 |
| 6,056,042 | A * | 5/2000 | Matsui | B22C 5/00 164/456 |
| 6,616,734 | B2 * | 9/2003 | Liu | B07B 1/00 210/321.63 |
| 2012/0256026 | A1 | 10/2012 | Matsukawa | |

FOREIGN PATENT DOCUMENTS

| | | |
|---|---|---|
| JP | 11-123498 | 5/1999 |
| JP | 2014-024097 | 2/2014 |
| JP | 57-61652 | 8/2015 |
| JP | 2017180964 A * | 10/2017 |
| WO | WO 2011/074628 | 6/2011 |

* cited by examiner

1a(1)
29
26
30
28
27
7
61
31
40
36
9
32
42
39
34
55
41
33
58
38
44
43
35
45
44
10
57
54
8(1b)
50
B
56
60
52
53
M
72(78)
51
74
73
71
75
59

CASTING SAND RECLAMATION SYSTEM AND CASTING SAND RECLAMATION METHOD

The present application is a U.S. National Stage of PCT International Patent Application No. PCT/JP2020/013652, filed Mar. 26, 2020, which claims priority to JP Application No. 2019-064128, filed Mar. 28, 2019, both of which are hereby incorporated herein by reference.

TECHNICAL FIELD

The present invention relates to a casting sand reclamation system and a casting sand reclamation method, and relates to a technique for improving reclamation accuracy and reclamation yield.

BACKGROUND ART

A binder is adhered to the surface of used casting sand (hereinafter, appropriately referred to as "recovered sand") recovered from a self-hardening sand mold used for casting. If the sand to which such a binder is adhered is reused as it is for a sand mold, the quality of the casting may be deteriorated. For this reason, specifying the amount of the binder adhering to the recovered sand is a great barometer for evaluating the reclamation efficiency. For example, in casting sand reclamation methods according to Patent Literatures 1 and 2, the weight loss value (ignition loss) when combustible contents contained in the recovered sand are burned is obtained, and the amount of the binder adhered is specified based on the ignition loss. In this manner, the reclamation efficiency is evaluated.

It is also known to measure the state of the casting sand after the reclamation process and provide feedback to the reclamation conditions. For example, in a casting sand reclamation method described in Patent Literature 3, the cleanliness of the casting sand after the reclamation process is measured, and the rotation speed of the crusher, the residence time in the processing container, etc. are adjusted based on the measurement result. Patent Literature 4 discloses that the degree of reclamation of the casting sand is measured during the reclamation process, and the reclamation process time is adjusted based on the measurement result. The applicant for this patent has developed a method for measuring the capacitance of the casting sand and converting it into an ignition loss (Patent Literature 5).

CITATIONS LIST

Patent Literatures

Patent Literature 1: JP H06-154941 A
Patent Literature 2: JP 2014-24097 A
Patent Literature 3: JP S59-169644 A
Patent Literature 4: JP H11-123498 A
Patent Literature 5: JP 5761652 B2

SUMMARY OF INVENTION

Technical Problems

The applicant manufactures a casting sand reclamation system including a batch-type polishing device that peels off a binder adhering to recovered sand by applying a mutual polishing action, and a continuous-type sorting device that sorts, by specific gravity, a sand grain group of the recovered sand supplied from the polishing device into a sand grain component that becomes reclamation sand and a fine grain component containing the binder by supplying compressed air, and conceives the idea of performing feedback control in which the measuring method for the capacitance of the casting sand of Patent Literature 5 is applied to the reclamation system. In other words, the applicant conceives, in the above-mentioned reclamation system, the idea of optimizing the reclamation process conditions by measuring the capacitance of the casting sand before and after the reclamation process and performing feedback control based on the change of both capacitances. However, since, in the recovered sand immediately after polishing by the polishing device of the above-mentioned reclamation system, the reclamation sand which is the sand grain component and the binder which is the fine grain component are mixed. Thus, even if the capacitance of the recovered sand delivered from the polishing device is measured, the state of the reclamation sand after the reclamation process cannot be accurately grasped. On the other hand, if the capacitance of the sand grain component after separation by the sorting device is measured, it is possible to accurately grasp the state of the reclamation sand. However, the sorting device accepts a plurality of batch processes by the polishing device, and continuously delivers the reclamation sand, and the sorting device delivers the reclamation sand randomly regardless of the order in which the recovered sand is loaded from the polishing device. Thus, it is inevitable that the correspondence between the recovered sand loaded into the polishing device and the reclamation sand delivered from the sorting device becomes unclear, and it is impossible to accurately grasp the polishing state when the recovered sand loaded into the polishing device is reclaimed into the reclamation sand.

An object of the present invention is to solve, in a casting sand reclamation system including a batch-type polishing device that peels off a binder adhering to recovered sand by applying a mutual polishing action, and a continuous-type sorting device that sorts, by specific gravity, a sand grain group of the recovered sand supplied from the polishing device into a sand grain component that becomes reclamation sand and a fine grain component containing the binder by supplying compressed air, and a reclamation method using the system, such a problem that, since the polishing device is a batch type and the sorting device is a continuous type, the correspondence between the recovered sand loaded into the polishing device and the reclamation sand delivered from the sorting device is unclear, with the result that the capacitance measurement for the reclamation sand after the reclamation process becomes impossible. In addition, an object of the present invention is to provide a casting sand reclamation system that can accurately grasp the properties of casting sand before and after the reclamation process based on the measurement result of the capacitance, and thus can contribute to the improvement of the reclamation accuracy and the reclamation yield of the casting sand, and a reclamation method using the system.

Solutions to Problems

The present invention is intended for a casting sand reclamation system that peels off a binder adhering to the surface of recovered sand 1*a* to obtain reclamation sand 1*b*. The reclamation system includes: a buffer device 6 in which the recovered sand 1*a* is stored; a polishing device 7 that includes a rotating body 33 rotated by a driving means 34 and peels off the binder adhering to the recovered sand 1*a* by applying a mutual polishing action to the recovered sand 1*a*; a supply control device 27 arranged between the buffer device 6 and the polishing device 7 to control a supply state of the recovered sand 1*a* from the buffer device 6 to the polishing device 7; a sorting device 10 that includes a blower means 50 and sorts, by specific gravity, a sand grain group of the recovered sand 1*a* supplied from the polishing device 7 into a sand grain component 8 that becomes the reclamation sand 1*b* and a fine grain component 9 containing the binder by supplying compressed air; an upstream capacitance measuring device 70 that is arranged on an upstream side of the polishing device 7 and measures capacitance of the recovered sand 1*a*; a downstream capacitance measuring device 71 that is arranged on a downstream side of the sorting device 10 and measures capacitance of the reclamation sand 1*b* as a sample; and a control device 80 that performs, based on measurement results of the capacitances by these capacitance measuring devices 70 and 71, feedback control of changing any one or more elements selected from an amount of the recovered sand 1*a* supplied by the supply control device 27 to the polishing device 7, a rotation speed of the rotating body 33 constituting the polishing device 7, a polishing time by the polishing device 7, and an amount of the compressed air supplied by the blower means 50 constituting the sorting device 10. The polishing device 7 is a batch-type device that intermittently processes the recovered sand 1*a* of a predetermined processing amount (A (kg)) sent from the buffer device 6. The sorting device 10 is a continuous-type device having a specific gravity sorting processing capacity for the recovered sand 1*a*, which is N times (N is an integer value of 2 or more) an amount of one processing (A (kg)) by the batch-type polishing device 7. The downstream capacitance measuring device 71 measures the capacitance of the reclamation sand 1*b* supplied from the sorting device 10 as a sample at a predetermined timing according to supply operation of the recovered sand 1*a* from the buffer device 6 to the polishing device 7. When a measurement result by the upstream capacitance measuring device 70, which is performed prior to an (n)th batch-type polishing process by the polishing device 7, is represented by "RU(n)", a measurement result by the downstream capacitance measuring result 71, which is executed at a predetermined timing according to the (n)th polishing process by the polishing device 7, is represented by "RD(n)", a measurement result by the downstream capacitance measuring result 71, which is executed at a predetermined timing according to an (n+1)th polishing process by the polishing device 7, is represented by "RD(n+1)", and a measurement result by the downstream capacitance measuring result 71, which is executed at a predetermined timing according to an (n+b)th polishing process by the polishing device 7, is represented by "RD(n+b)", the control device 80 performs feedback control based on comparison between a value of "RU(n)" and an "average value of RD(n)" calculated by {"RD(n+1)"+"RD(n+2)"+ . . . "RD(n+N)"}/N. When the ratio between the processing amount by the polishing device 7 and the specific gravity sorting processing capacity amount by the specific gravity sorting device 10 is an integer value, the integer value is a value of "N". When the ratio is not an integer value, an integer value obtained by rounding off the decimal point of the ratio or an integer value obtained by rounding down or rounding up the decimal point of the ratio can be set as the value of "N".

The control device 80 calculates a rate of change of the capacitance before and after a reclamation process based on the value of "RU(n)" and the "average value of RD(n)", and performs feedback control based on the rate of change.

The casting sand reclamation system includes a sand flow path 16 through which the casting sand 1 flows, and the buffer device 6, the polishing device 7, and the sorting device 10 are arranged on the sand flow path 16 in the stated order. The upstream capacitance measuring device 70 and the downstream capacitance measuring device 71 each include an extraction means 72 that extracts part of the casting sand 1 flowing in the sand flow path 16 as a sample, an upstream branch flow path 73 that receives the casting sand 1 extracted by the extraction means 72, and a measuring unit 74 that measures capacitance of a predetermined amount of the casting sand 1 supplied from the upstream branch flow path 73. When a detection command from the control device 80 is received, the extraction means 72 is driven so that a predetermined amount of the casting sand 1 is extracted from the sand flow path 16 to the upstream branch flow path 73, and measurement operation for the capacitance of the casting sand 1 by the measuring unit 74 is performed.

The upstream capacitance measuring device 70 and the downstream capacitance measuring device 71 each include a downstream branch flow path 75 that receives the casting sand 1 after the measurement by the measuring unit 74 and allows the casting sand 1 to flow through the sand flow path 16.

Further, the present invention is intended for a casting sand reclamation method of peeling off a binder adhering to the surface of recovered sand 1*a* to obtain reclamation sand 1*b*. This reclamation method includes: a first capacitance measurement step (S1) of measuring capacitance of the recovered sand 1*a* as a sample prior to a polishing process; a polishing step (S2) of performing a polishing process of peeling off the binder adhering to the recovered sand 1*a* by applying a mutual polishing action to a predetermined amount of the recovered sand 1*a* using a batch-type polishing device 7; a sorting step (S3) of performing a process of sorting, by specific gravity, a sand grain group of the recovered sand 1*a* supplied from the polishing device 7 into a sand grain component 8 that becomes the reclamation sand 1*b* and a fine grain component 9 containing the binder by supplying compressed air using a sorting device 10 including a blower means 50; a second capacitance measurement step (S4) of measuring capacitance of the reclamation sand 1*b* after the sorting as a sample; and a feedback step (S5) of changing any one or more elements selected from an amount of the recovered sand 1*a* supplied by the polishing device 7 responsible for the polishing process, a rotation speed of a rotating body 33 constituting the polishing device 7, a polishing time by the polishing device 7, and an amount of the compressed air supplied by the blower means 50 constituting the sorting device 10 responsible for the specific gravity sorting process based on a measurement value in the first capacitance measurement step (S1) and a measurement value in the second capacitance measurement step (S4). The sorting device 10 is a continuous-type device having a specific gravity sorting processing capacity for the recovered sand (1*a*), which is N times the amount of one processing (A (kg)) by the batch-type polishing device 7. In the second capacitance measurement step (S4), the capacitance of the reclamation sand 1*b* supplied from the sorting device 10 is measured as a sample at a predetermined timing according to supply operation of the recovered sand 1*a* to the polishing device 7. When a measurement result in the first capacitance measurement step (S1), which is performed prior to an (n)th batch-type polishing process by the polishing device (7), is represented by "RU(n)", a measurement result in the second capacitance measurement step (S4), which is executed at a predetermined timing according to the (n)th polishing process by the polishing device (7), is represented by "RD(n)", a measurement result in the second capacitance measurement step (S4), which is executed at a predetermined timing according to an (n+1)th polishing process by the polishing device (7), is represented by "RD(n+1)", and a measurement result in the second capacitance measurement step (S4), which is executed at a predetermined timing according to an (n+b)th polishing process by the polishing device (7), is represented by "RD(n+b)", in the feedback step (S5), feedback control is performed based on comparison between a value of "RU(n)" and an "average value of RD(n)" calculated by {"RD(n+1)"+"RD(n+2)"+ . . . "RD(n+N)"}1/N.

In the feedback step (S5), a rate of change of the capacitance before and after a reclamation process is calculated based on the value of "RU(n)" and the "average value of RD(n)", and feedback control is performed based on the rate of change.

Advantageous Effects of Invention

In the reclamation system according to the present invention, the average value "average value of RD(n)" of results of the measurement of a total of N times by the downstream capacitance measuring device 71, which is executed at a predetermined timing according to the (n+1)th to (n+N)th polishing processes by the polishing device 7, is calculated. Thus, it is possible to approximately obtain the capacitance of the reclamation sand 1*b* polished by the batch-type polishing device 7 and generated by each batch while employing the continuous-type sorting device 10. That is, in the reclamation system of the present invention, under a state in which there is an extremely high possibility that the reclamation sand 1*b* obtained by the polishing process of each batch by the polishing device 7 remains in the sorting device 10, the average value of the measurement results by the downstream capacitance measuring device 71 is calculated by summing up the measurement results of many times (N times) by the downstream capacitance measuring device 71, which are sent from the sorting device 10, and dividing the total value by the value (N) related to the specific gravity sorting processing capacity value of the sorting device 10 compared with the polishing device 7. Thus, the capacitance of the reclamation sand 1*b* obtained by the polishing process of each batch by the polishing device 7 can be approximately recreated as the average value. From the above, according to the present invention, the capacitance of the reclamation sand 1*b* can be approximately obtained by solving the following problem. Specifically, since the polishing device 7 is a batch type and the sorting device 10 is a continuous type, the correspondence between the recovered sand 1*a* loaded into the polishing device 7 and the reclamation sand 1*b* delivered from the sorting device 10 is unclear, with the result that the capacitance measurement for the reclamation sand 1*b* after the reclamation process becomes impossible.

Then, in the present invention, feedback control is performed based on the measurement results of the capacitances of the casting sand 1 (recovered sand 1*a* and reclamation sand 1*b*) measured on the upstream side and the downstream side of the polishing device 7. Thus, the properties of the casting sand 1, such as the amount of the binder adhering to the recovered sand 1*a* immediately before the reclamation process and the residual amount of the binder adhering to the reclamation sand 1*b* immediately after the reclamation process can be accurately grasped, and the reclamation process can be executed on the recovered sand 1*a* under more appropriate reclamation process conditions (polishing conditions and sorting conditions for the casting sand 1). As a result, it is possible to prevent poor polishing such as insufficient peeling of the binder and poor sorting such as insufficient separation of the reclamation sand 1*b* and the binder, so that the reclamation accuracy can be improved. In addition, it is possible to prevent the reclamation sand 1*b* from becoming finer due to excessive scraping of the recovered sand 1*a* during the polishing process, so that the reclamation yield can be improved. Since it is possible to grasp a decrease in the polishing ability of the polishing device 7 due to wear of the rotating body 33, etc., it is possible to accurately know when to replace the rotating body 33, etc., thereby being also capable of contributing to improvement in the maintainability of the reclamation system.

Since the feedback control is performed based on the rate of change of the capacitance of the casting sand 1 before and after the reclamation process, the capacitance of the reclamation sand 1*b* after the process in the next stage process can be predicted, for example, based on the rate of change of the capacitance of the casting sand 1 before and after the process in the previous stage and the capacitance of the recovered sand 1*a* before the process in the next stage process, and it is possible to change the reclamation process conditions so that the capacitance of the reclamation sand 1*b* after the process in the next stage process becomes an optimum value. In addition, by changing the reclamation process conditions so that the capacitance of the reclamation sand 1*b* after the process in the next stage process approaches the upper limit value of the target value, it is possible to prevent the obtained reclamation sand 1*b* from becoming finer due to excessive scraping of the recovered sand 1*a*, so that it is possible to suppress a decrease in the reclamation yield.

The capacitance measuring devices 70 and 71 each include the extraction means 72 that extracts part of the casting sand 1 flowing in the sand flow path 16 as a sample, the upstream branch flow path 73 that receives the casting sand 1 extracted by the extraction means 72, and the measuring unit 74 that measures the capacitance of the predetermined amount of the casting sand 1 supplied from the upstream branch flow path 73. With a configuration in which, when a detection command is received, the extraction means 72 is driven so that the predetermined amount of the casting sand 1 is extracted from the sand flow path 16 to the upstream branch flow path 73, and measurement operation for the capacitance of the casting sand 1 by the measuring unit 74 is performed, the measurement operation for the capacitance of the casting sand 1 can be automated, so that it is possible to automate the entire reclamation system including feedback control. As a result, the reclamation process by the reclamation system can proceed quickly and speedily.

When the capacitance measuring devices 70 and 71 each include the downstream branch flow path 75 that receives the casting sand 1 after the measurement by the measuring unit 74 and allows the casting sand 1 to flow through the sand flow path 16, the casting sand 1 can be allowed to flow through the sand flow path 16 via the downstream branch flow path 75 after the measurement by the measuring unit 74. As a result, the casting sand 1 extracted as a sample at the time of capacitance measurement is not discarded, and the extracted casting sand 1 can also be used as the reclamation sand. Therefore, the casting sand 1 can be prevented from being reduced by being extracted by the capacitance measuring devices 70 and 71 to suppress the decrease in the reclamation yield.

In the reclamation method according to the present invention, the average value "average value of RD(n)" of results of the measurement of a total of N times by the second capacitance measurement step (S4), which is executed at a predetermined timing according to the (n+1)th to (n+N)th polishing processes by the polishing device 7, is calculated. Thus, it is possible to approximately obtain the capacitance of the reclamation sand 1*b* polished by the batch-type polishing device 7 and generated by each batch while employing the continuous-type sorting device 10. That is, in the reclamation method of the present invention, under a state in which a possibility that the reclamation sand 1*b* obtained by the polishing process of each batch by the polishing device 7 remains in the sorting device 10 is high, the average value of the measurement results by the second capacitance measurement step (S4) is calculated by summing up the measurement results of many times (N times) by the second capacitance measurement step (S4), which are sent from the sorting device 10, and dividing the total value by the value (N) related to the specific gravity sorting processing capacity value of the sorting device 10 compared with the polishing device 7. Thus, the capacitance of the reclamation sand 1*b* obtained by the polishing process of each batch can be approximately recreated. From the above, the capacitance of the reclamation sand 1*b* can be approximately obtained by solving the following problem. Specifically, since the polishing device 7 is a batch type and the sorting device 10 is a continuous type, the correspondence between the recovered sand 1*a* loaded into the polishing device 7 and the reclamation sand 1*b* delivered from the sorting device 10 is unclear, with the result that the capacitance measurement for the reclamation sand 1*b* after the reclamation process becomes impossible.

Then, in the present invention, feedback control is performed based on the measurement results of the capacitances of the casting sand 1 (recovered sand 1*a* and reclamation sand 1*b*) measured on the upstream side and the downstream side of the polishing device 7. Thus, the properties of the casting sand 1, such as the amount of the binder adhering to the recovered sand 1*a* immediately before the reclamation process and the residual amount of the binder adhering to the reclamation sand 1*b* immediately after the reclamation process can be accurately grasped, and the reclamation process can be executed on the recovered sand 1*a* under more appropriate reclamation process conditions (polishing conditions and sorting conditions for the casting sand 1). As a result, it is possible to prevent poor polishing such as insufficient peeling of the binder and poor sorting such as insufficient separation of the reclamation sand 1*b* and the binder, so that the reclamation accuracy can be improved. In addition, it is possible to prevent the reclamation sand 1*b* from becoming finer due to excessive scraping of the recovered sand 1*a* during the polishing process, so that the reclamation yield can be improved. Since it is possible to grasp a decrease in the polishing ability of the polishing device 7, it can also contribute to improvement in the maintainability of the polishing device 7.

Since the feedback control is performed based on the rate of change of the capacitance of the casting sand 1 before and after the reclamation process, the capacitance of the reclamation sand 1*b* after the process in the next stage process can be predicted, for example, based on the rate of change of the capacitance of the casting sand 1 before and after the process in the previous stage and the capacitance of the recovered sand 1*a* before the process in the next stage process, and it is possible to change the reclamation process conditions so that the capacitance of the reclamation sand 1*b* after the process in the next stage process becomes an optimum value. In addition, by changing the reclamation process conditions so that the capacitance of the reclamation sand 1*b* after the process in the next stage process approaches the upper limit value of the target value, it is possible to prevent the obtained reclamation sand 1*b* from becoming finer due to excessive scraping of the recovered sand 1*a*, so that it is possible to suppress a decrease in the reclamation yield.

BRIEF DESCRIPTION OF DRAWINGS

DESCRIPTION OF EMBODIMENTS (First embodiment) FIGS. 1 to 11 show a casting sand reclamation system and a casting sand reclamation method according to a first embodiment of the present invention. The reclamation system shown in this embodiment performs processing on casting sand 1, and performs a reclamation process on the used and recovered casting sand 1 (hereinafter referred to as "recovered sand 1*a*"), thereby obtaining reclamation sand 1*b*. In FIG. 1, the reclamation system includes a sand crusher 3 that crushes the recovered sand 1*a* loaded in as a sand lump, a vibra screen 4 that sifts foreign matter such as burrs contained in the recovered sand 1*a* by vibration, a magnet separator 5 that separates iron pieces and the like contained in the recovered sand 1*a* by magnetic force, a buffer hopper (buffer device) 6 for storing sand, in which the recovered sand 1*a* is stored, a polishing device 7 that peels off the binder adhering to the recovered sand 1*a* by applying a mutual polishing action to the recovered sand 1*a*, a sorting device 10 that sorts, by specific gravity, the recovered sand 1*a* that flows out from the polishing device 7 into a sand grain component 8 that becomes the reclamation sand 1*b* and a fine grain component 9 containing the binder (see FIG. 2), a sand cooler 11 that cools the reclamation sand 1*b*, a sand tank 12 in which the cooled reclamation sand 1*b* is stored, and the like. In FIG. 1, reference numeral 14 is a first bucket elevator that sends the recovered sand 1*a* crushed by the sand crusher 3 to the vibra screen 4, and reference numeral 15 is a second bucket elevator that sends the reclamation sand 1*b* sorted by the sorting device 10 to the sand cooler 11. The reclamation system is provided with a sand flow path 16 including these first and second bucket elevators 14 and 15, through which the casting sand 1 (recovered sand 1*a* and reclamation sand 1*b*) flows, and on the sand flow path 16, the sand crusher 3, the vibra screen 4, the magnet separator 5, the buffer hopper 6, the polishing device 7, the sorting device 10, the sand cooler 11, and the sand tank 12 are arranged in the stated order from an upstream side to a downstream side.

Figure 1:
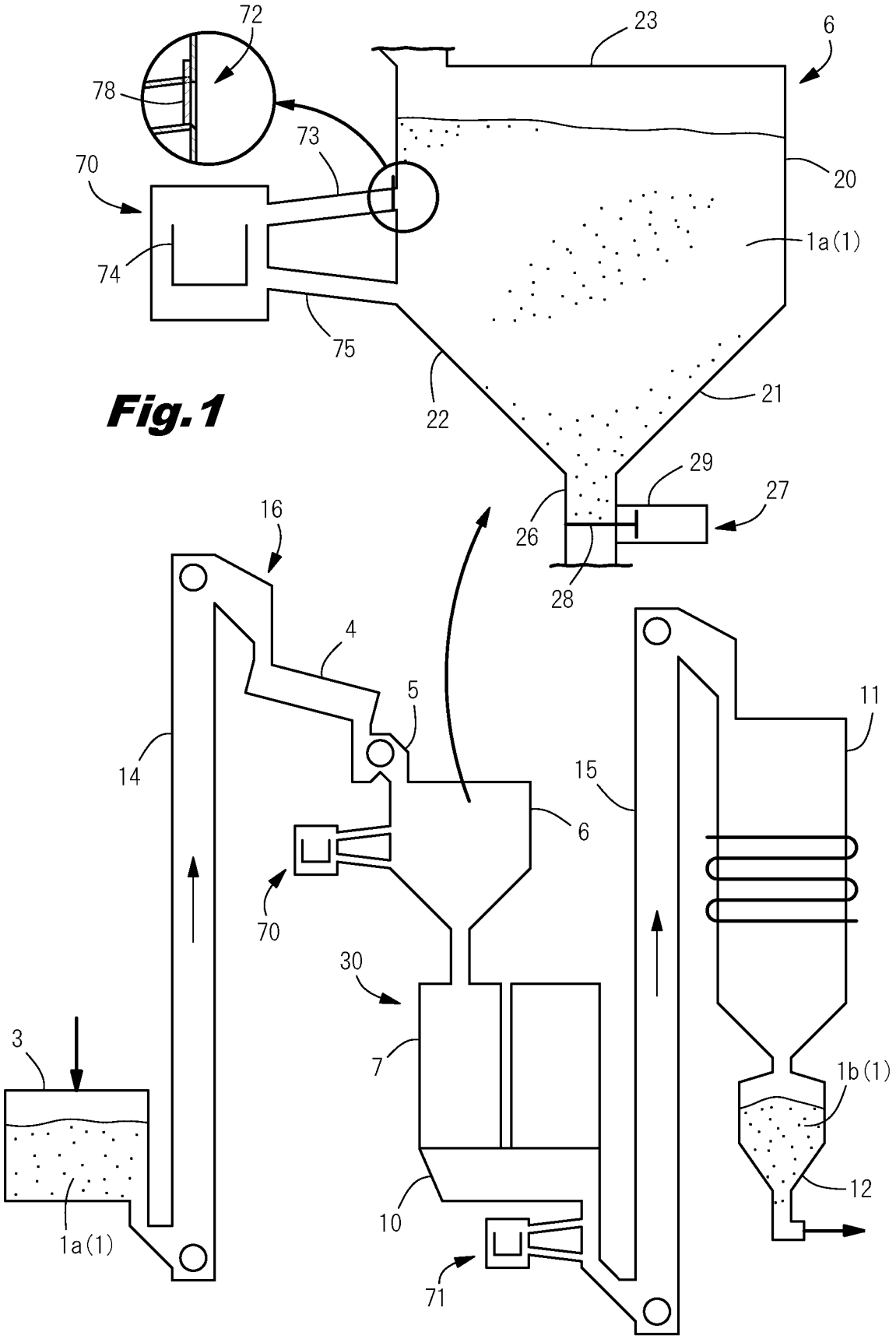
FIG. 1 is a schematic configuration diagram of a casting sand reclamation system according to a first embodiment of the present invention.

As shown in an enlarged manner in FIG. 1, the buffer hopper 6 temporarily receives the recovered sand 1*a* supplied through the sand crusher 3, the first bucket elevator 14, the vibra screen 4, and the magnet separator 5, stores the recovered sand 1*a* for a certain period of time, and supplies the recovered sand 1*a* to the polishing device 7 provided on the downstream side of the sand flow path 16. The buffer hopper 6 includes a straight portion 20 having a uniform diameter on the upper side, a housing 22 having a downstream-narrowed tapered portion 21 on the lower side, and a cover body 23 that closes an upper opening of the housing 22. The buffer hopper 6 is a first-in first-out storage device that sequentially delivers the supplied recovered sand 1*a* to the outside of the device, and sequentially delivers the recovered sand 1*a* supplied from the upper side toward the polishing device 7 arranged on the lower side. A supply flow path 26 for the recovered sand 1*a* leading to the polishing device 7 is connected to the outlet at the lower end of the tapered portion 21, and a supply control device 27 that controls a supply state of the recovered sand 1*a* from the buffer hopper 6 to the polishing device 7 is arranged on this supply flow path 26.

The supply control device 27 includes a valve body 28 configured to freely move in and out between a closed posture in which the supply flow path 26 is closed and an open posture in which the supply flow path 26 is opened, and an actuator 29 that controls the moving in and out of the valve body 28. In the normal state, the valve body 28 is in the closed posture, and when the actuator 29 is turned on and the valve body 28 is brought into the open posture in response to a control signal from a control device 80 described later, the recovered sand 1*a* in the buffer hopper 6 drops toward the polishing device 7 by its own weight. By changing the opening time of the valve body 28 to be short and long at this time, the supply amount of the recovered sand 1*a* from the buffer hopper 6 to the polishing device 7 can be controlled.

Figure 2:
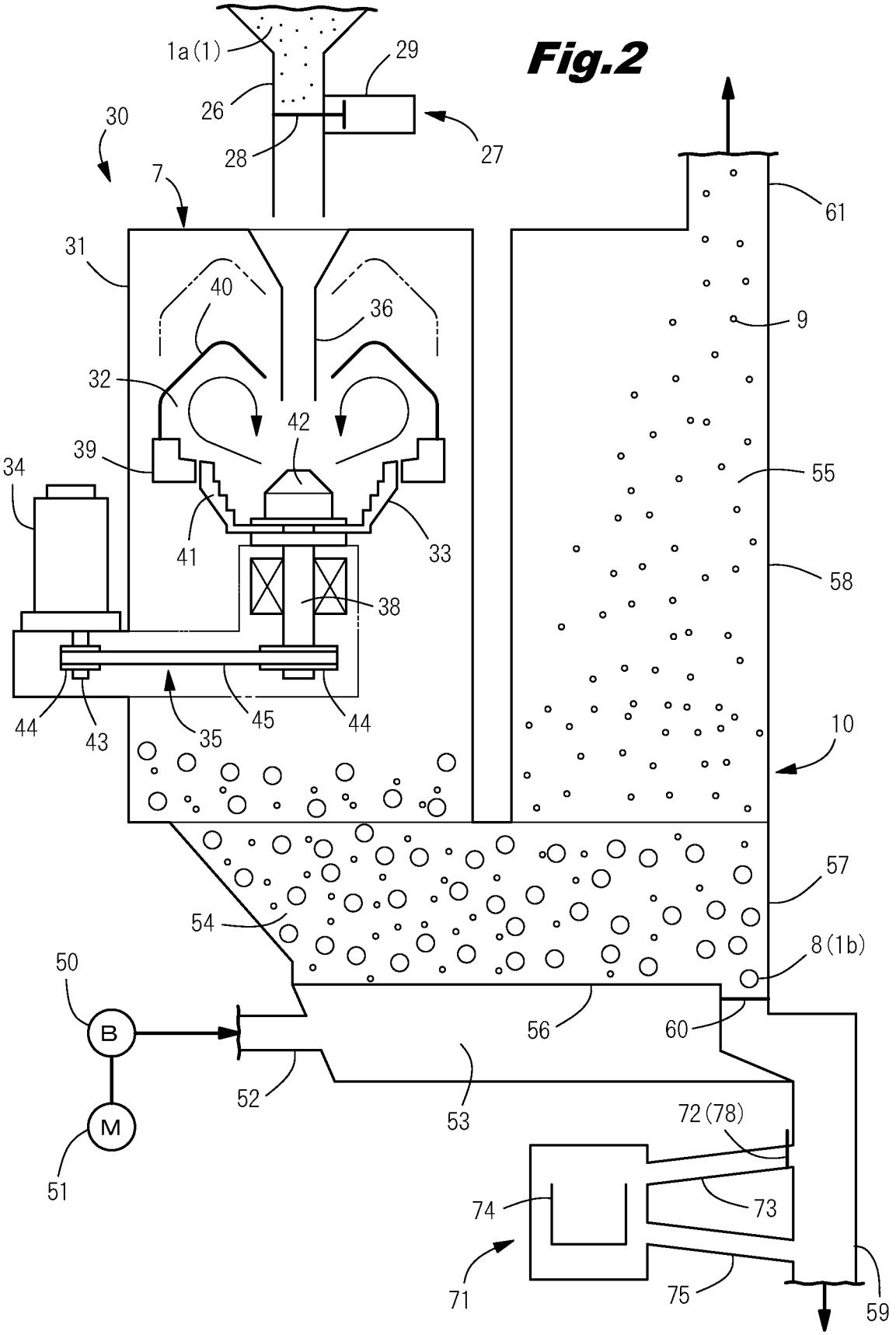
FIG. 2 is a schematic configuration diagram showing a reclamation device constituting the casting sand reclamation system.

In FIG. 2, reference numeral 30 is a reclamation device including the polishing device 7 and the sorting device 10 integrally. The polishing device 7 is a batch-type centrifugal polishing machine, and includes a casing 31, a polishing chamber 32 that is provided inside the casing 31 and applies a mutual polishing action to the recovered sand 1*a* supplied from the buffer hopper 6, a rotor motor (driving means) 34 that applies driving force to a rotor (rotating body) 33 that constitutes the polishing chamber 32, a transmission mechanism 35 that applies the driving force of the rotor motor 34 to the rotor 33, a guide cylinder 36 that guides the recovered sand 1*a* supplied from the supply flow path 26 into the polishing chamber 32, and the like. The polishing chamber 32 includes the rotor 33 that is located on the lower side and rotates around a rotation shaft 38, an immovable blade body 39 arranged so as to surround the peripheral edge of the rotor 33, and a ring hood 40 located on the upper side. The rotor 33 includes a container-shaped rotor body 41 having an upper opening, a center cone 42 arranged at the center of the rotor body 41, and the like. The inner surface of the rotor body 41 is formed in a stepped shape, and a rotor edge is arranged on the outermost peripheral edge. The transmission mechanism 35 includes pulleys 44 and 44 mounted on an output shaft 43 on the rotor motor 34 side and the rotation shaft 38, respectively, a timing belt 45 stretched between both the pulleys 44 and 44, and the like.

The ring hood 40 is formed in a bottomless tubular shape widened downward and having an opening in the vertical direction, and is configured to be vertically movable by an actuator (not shown) between a lower position at which the lower opening edge is in contact with the blade body 39 to close the polishing chamber 32, and an upper position at which a gap is formed between the opening edge and the blade body 39. In FIG. 2, the ring hood 40 at the lower position is shown by a solid line, and the ring hood 40 at the upper position is shown by a virtual line. The upper opening of the ring hood 40 is a through hole that allows the guide cylinder 36 to enter. Under a state in which the rotor motor 34 is turned on and the rotor 33 is rotated, a predetermined amount of the recovered sand 1*a* is supplied from the guide cylinder 36 into the polishing chamber 32, thereby applying a mutual polishing action to the recovered sand 1*a*, so that the binder adhering to the recovered sand 1*a* can be peeled off. At this time, the rotation speed of the rotor 33 can be controlled by controlling the rotation speed of the rotor motor 34. Further, by moving the ring hood 40 from the lower position to the upper position while rotating the rotor motor 34 after a polishing process, the recovered sand 1*a* after the polishing process can be delivered to the outside of the polishing chamber 32. Therefore, by controlling the movement timing of the ring hood 40 to the upper position, it is possible to control the polishing time in one batch process. In this embodiment, the maximum processing amount in one batch process by the polishing device 7 is set to 30 kg. That is, the maximum amount of the recovered sand 1*a* that can be polished by the polishing device 7 in one batch process is set to 30 kg.

The sorting device 10 includes a blower 50 (blower means) that generates compressed air, a blower motor 51 that is a drive source of the blower 50, an air chamber 53 that receives the compressed air generated by the blower 50 via a blower pipe 52, a sorting chamber 54 provided above the air chamber 53, a floating chamber 55 in which a fine grain component 9 blown up by the compressed air floats, and a partition wall 56 that separates the sorting chamber 54 and the air chamber 53. The sorting device 10 is a continuous-type device having a specific gravity sorting processing capacity for the recovered sand 1*a*, which is N times the amount of one processing (A (kg)) by the batch-type polishing device 7. In this embodiment, as described above, the maximum processing amount in one batch process by the polishing device 7 is set to 30 kg, whereas the maximum specific gravity sorting processing capacity by the sorting device 10 is set to 150 kg. The value of N above is set to "5".

The sorting chamber 54 and the air chamber 53 are formed in a horizontally long lower housing 57, and the floating chamber 55 is formed in an upper housing 58 provided so as to be aligned with the casing 31 of the polishing device 7. The partition wall 56 is provided with a large number of air injection holes. A sand discharge flow path 59 for delivering the reclamation sand 1*b* to the next process is formed on the downstream side of the sorting chamber 54, and an opening/closing gate 60 that is opened/ closed by an actuator (not shown) is provided at the boundary between the sorting chamber 54 and the sand discharge flow path 59. At the upper end of the floating chamber 55, a dust collecting port 61 leading to a dust collector (not shown) is provided.

The compressed air generated by the blower 50 is blown to the sorting chamber 54 through the blower pipe 52, the air chamber 53, and the air injection holes of the partition wall 56, and ascending force is caused to act on the casting sand 1 in the sorting chamber 54 by the compressed air. At this time, the sand grain component 8 that becomes the reclamation sand 1*b* is settled on the partition wall 56 by gravity, and the fine grain component 9 containing the binder floats in the floating chamber 55 and is discharged from the dust collecting port 61. That is, the sand grain component 8 that becomes the reclamation sand 1*b* having large specific gravity stays in the sorting chamber 54 due to its own weight, and the fine grain component 9 containing the binder having small specific gravity floats in the floating chamber 55 and is discharged from the dust collecting port 61. As a result, the casting sand 1 after the polishing process can be sorted by specific gravity into the reclamation sand 1*b* and the binder. At this time, by controlling the rotation speed of the blower motor 51, the amount of the compressed air supplied from the blower 50 can be changed to change the ascending force acting on the sand grain component 8 and the fine grain component 9, so that the upper limit specific gravity of the fine grain component 9 to be collected by a dust collector can be adjusted to be large or small. More specifically, when the amount of the compressed air supplied from the blower 50 is reduced, even the sand grain component 8 having smaller specific gravity can be included in the reclamation sand 1*b*, so that the reclamation yield can be expected to be improved. On the other hand, since the fine grain component 9 containing a binder having large specific gravity is included in the reclamation sand 1*b*, the separation between the reclamation sand 1*b* and the binder may be insufficient. On the contrary, when the amount of the compressed air supplied from the blower 50 is increased, it is possible to collect dust up to the fine grain component 9 having larger specific gravity, so that the separation efficiency between the reclamation sand 1*b* and the binder is improved. On the other hand, since the sand grain component 8 having small specific gravity is collected by the dust collector, the reclamation yield may decrease.

The sand grain component 8 that becomes the reclamation sand 1*b* is settled on the partition wall 56, and then discharged from the sand discharge flow path 59 when the opening/closing gate 60 is opened. The reclamation sand 1*b* discharged from the sand discharge flow path 59 is sent to the sand cooler 11 via the second bucket elevator 15 to be cooled, and then stored in the sand tank 12.

Then, the reclamation system according to this embodiment is notable in the following matters. Specifically, capacitance measuring devices 70 and 71 are arranged on the upstream side and the downstream side of the reclamation device 30 in the sand flow path 16, respectively, and the capacitance of the recovered sand 1*a* before the reclamation process and the capacitance of the reclamation sand 1*b* after the reclamation process are measured. Based on these measurement results, feedback control of changing any one or more elements selected from the amount of the recovered sand 1*a* supplied by the supply control device 27 to the polishing device 7, the rotation speed of the rotor 33 constituting the polishing device 7, the polishing time by the polishing device 7, and the amount of the compressed air supplied by the blower 50 constituting the sorting device 10 is performed.

As shown in FIG. 1, in the buffer hopper 6, a first measuring device (upstream capacitance measuring device) 70 that measures the capacitance of the recovered sand 1*a* stored in the buffer hopper 6 as a sample is arranged. In the sand discharge flow path 59 of the sorting device 10, a second measuring device (downstream capacitance measuring device) 71 that measures the capacitance of the reclamation sand 1*b* after sorting by the sorting device 10 as a sample is arranged. The first measuring device 70 includes an extraction mechanism (extraction means) 72 that extracts part of the recovered sand 1*a* as a sample from the inside of the buffer hopper 6, an upstream branch flow path 73 that receives the recovered sand 1*a* extracted by the extraction mechanism 72, a measuring unit 74 that measures the capacitance of the predetermined amount of the recovered sand 1*a* supplied from the upstream branch flow path 73, and a downstream branch flow path 75 that receives the recovered sand 1*a* after the measurement by the measuring unit 74 and allows the recovered sand 1*a* to flow through the buffer hopper 6.

The extraction mechanism 72 includes an on-off valve 78 configured to be openable and closable between a closed posture in which an opening communicating with the upstream branch flow path 73 is closed and an open posture in which the opening is opened, and an actuator (not shown) that performs opening/closing control for the on-off valve 78, and can allow the predetermined amount of the recovered sand 1*a* to flow into the upstream branch flow path 73 as a sample when the on-off valve 78 is in the open posture for a predetermined time (about several seconds). The upstream branch flow path 73 is inclined downward, and guides the recovered sand 1*a* extracted as a sample by the extraction mechanism 72 to the measuring unit 74. The measuring unit 74 measures the capacitance of the recovered sand 1*a* after heat-treating the recovered sand 1*a* to reduce the water content to 0.1% or less, and includes a measurement container in which the recovered sand 1*a* is accommodated, a heater that supplies hot air to the recovered sand 1*a* in the measuring container, a delivery mechanism that delivers the recovered sand 1*a* to the downstream branch flow path 75 after the measurement, and the like. The recovered sand 1*a* after the measurement is returned to the buffer hopper 6 via the downstream branch flow path 75. Since the configuration of the second measuring device 71 is the same as the configuration of the first measuring device 70, the same members are designated by the same reference numerals and the description thereof will be omitted.

In a mode in which the recovered sand 1*a* stored in the buffer hopper 6 is measured by the first measuring device 70 as described above, there is a risk that the sand group containing the recovered sand 1*a* measured by the sample measurement and the sand group of the recovered sand 1*a* actually loaded into the polishing device 7 may be different from each other. If the sand group containing the recovered sand 1*a* measured by the sample measurement and the sand group of the recovered sand 1*a* actually loaded into the polishing device 7 are different from each other as described above, an accurate reclamation process cannot be performed for the recovered sand 1*a* loaded into the polishing device 7, and it is inevitable that the processing accuracy will decrease. Therefore, in this embodiment, the time lag until the recovered sand 1*a* is loaded into the polishing device 7 from the sample collected position in the buffer hopper 6 by the first measuring device 70 is calculated by an arithmetic control unit 82 of the control device 80, which will be described later, and the reclamation process conditions are feedback-controlled based on the time lag and the capacitance measured by the first measuring device 70. In this manner, the sand group containing the recovered sand 1*a* measured as a sample by the first measuring device 70 and the sand group of the recovered sand 1*a* loaded into the polishing device 7 match each other.

Figure 3:
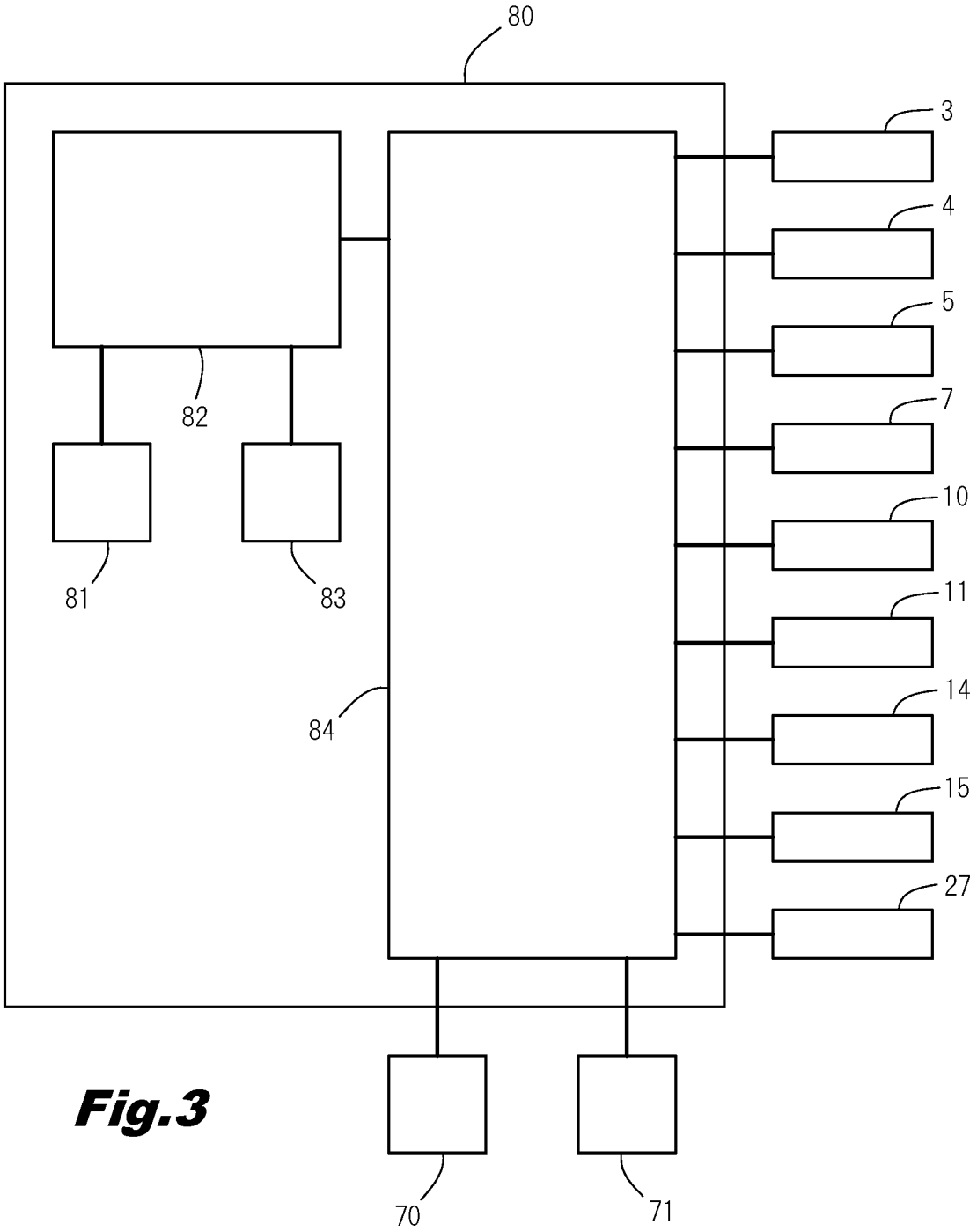
FIG. 3 is a block diagram showing a control system of the casting sand reclamation system.

FIG. 3 shows a block diagram of the reclamation system according to this embodiment. The control device 80 responsible for controlling the reclamation system includes a ROM 81 in which a control program is stored, the arithmetic control unit 82 that controls the entire system based on the control program, a RAM 83 that is a work area of the arithmetic control unit 82, an input/output unit 84 that receives input signals from various sensors and issues a control signal to each of the devices constituting the reclamation system based on the arithmetic result by the arithmetic control unit 82, and the like.

As objects to be controlled by the control device 80 related to the feedback control, there are given opening/closing control of the valve body 28 constituting the supply control device 27, rotation speed control of the rotor motor 34 constituting the polishing device 7, vertical movement control of the ring hood 40 constituting the polishing device 7, rotation speed control of the blower motor 51 constituting the blower 50, opening/closing control of the on-off valve 78 of each of the measuring devices 70 and 71, and the like. Each of these devices is controlled based on the control signal issued from the input/output unit 84 in response to a control command from the arithmetic control unit 82. As described above, by changing the opening time of the valve body 28 of the supply control device 27 to be short and long, the supply amount of the recovered sand 1*a* from the buffer hopper 6 to the polishing device 7 can be controlled. By controlling the rotation speed of the rotor motor 34, the rotation speed of the rotor 33 can be controlled. By controlling the movement timing of the ring hood 40 to the upper position, it is possible to control the polishing time in one batch process in the polishing device 7. By controlling the rotation speed of the blower motor 51, it is possible to control the amount of the compressed air blown from the blower 50.

A detection signal related to the capacitances measured by the first measuring device 70 and the second measuring device 71 is input to the input/output unit 84. The capacitances measured by these measuring devices 70 and 71 are stored in the RAM 83, and the arithmetic control unit 82 performs, based on these capacitances, feedback control of changing any one or more elements selected from the amount of the recovered sand 1*a* supplied from the buffer hopper 6 to the polishing device 7, the rotation speed of the rotor 33, the polishing time in one batch process in the polishing device 7, and the amount of the compressed air blown from the blower 50. In this embodiment, the capacitances measured by the first measuring device 70 and the second measuring device 71 are converted into DC voltages by a converter, and the input/output unit 84 performs feedback control based on the voltage values output from the converters. The converter outputs voltages proportional to the measured capacitances.

Figure 11:
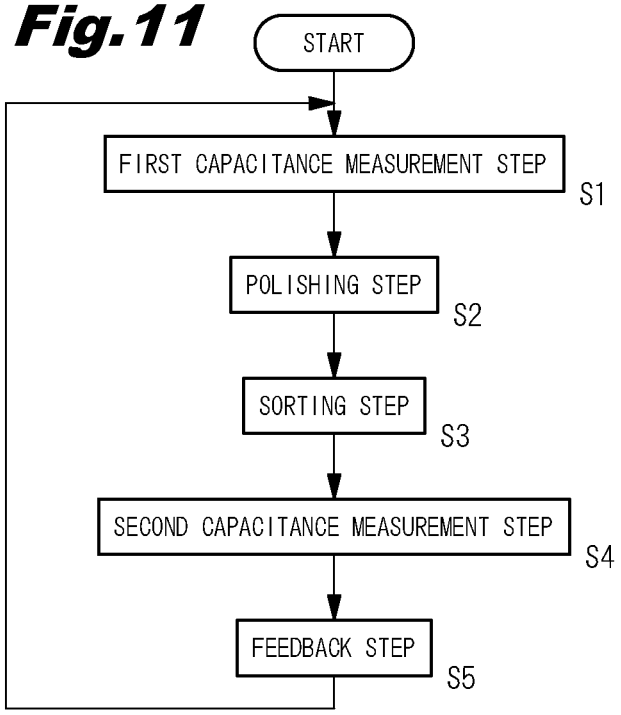
FIG. 11 is a flowchart for explaining a method for regenerating casting sand according to the first embodiment of the present invention.

FIG. 11 shows a flowchart for explaining the reclamation method for casting sand of this embodiment. As shown in FIG. 11, in this reclamation method, reclamation for the casting sand 1 is performed in the order of a first capacitance measurement step (S1) by the first measuring device 70, a polishing step (S2) by the polishing device 7, a sorting step (S3) by the sorting device 10, a second capacitance measurement step (S4) by the second measuring device 71, and a feedback step (S5) in which feedback control is performed based on the measurement results in the first capacitance measurement step (S1) and the second capacitance measurement step (S4) (voltage values converted from the capacitances by the converter).

Figure 4:
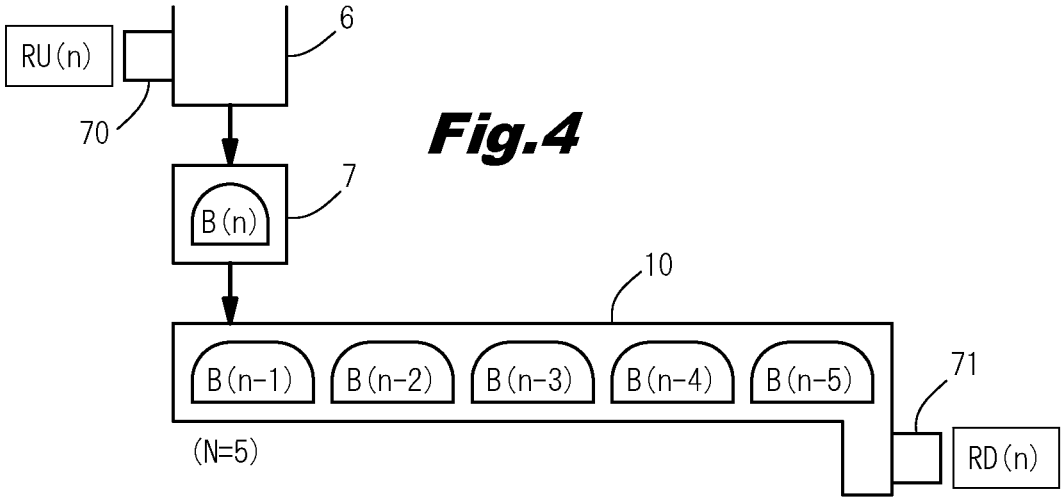
FIG. 4 is a schematic diagram of the reclamation system for explaining a method of calculating an "average value of RD(n)".

With reference to FIGS. 4 and 5(A) to 5(C), a method of calculating the average value "average value of RD(n)" of the total N times of measurement results by the second measuring device 71 will be described. FIG. 4 is a diagram schematically showing the state of the reclamation system when the polishing process of the nth batch (B(n)) by the polishing device 7 is executed. In FIG. 4, RU(n) represents the measurement result by the first measuring device 70, which is performed prior to the nth batch-type polishing process by the polishing device 7, and RD(n) represents the measurement result by the second measuring device 71, which is executed at a predetermined timing according to the (n)th polishing process by the polishing device 7. As described above, the maximum processing amount in one batch process by the polishing device 7 is set to 30 kg, whereas the maximum specific gravity sorting processing capacity by the sorting device 10 is set to 150 kg, and the value of N is set to "5". Thus, the reclamation sand 1*b* after the polishing process for a total of 5 batches of B(n−1) to B(n−5) is accommodated in the sorting device 10 in a state where the sand grain component 8 that becomes the reclamation sand 1*b* and the fine grain component 9 containing the binder are mixed. The reclamation sand 1*b* delivered from the inside of the sorting device 10 via the sand discharge flow path 59 is not delivered in the order of B(n−5) to B(n−1) by the first-in first-out method, but the reclamation sand 1*b* is delivered regardless of the loading order (randomly).

Figures 5A, 5B, 5C:
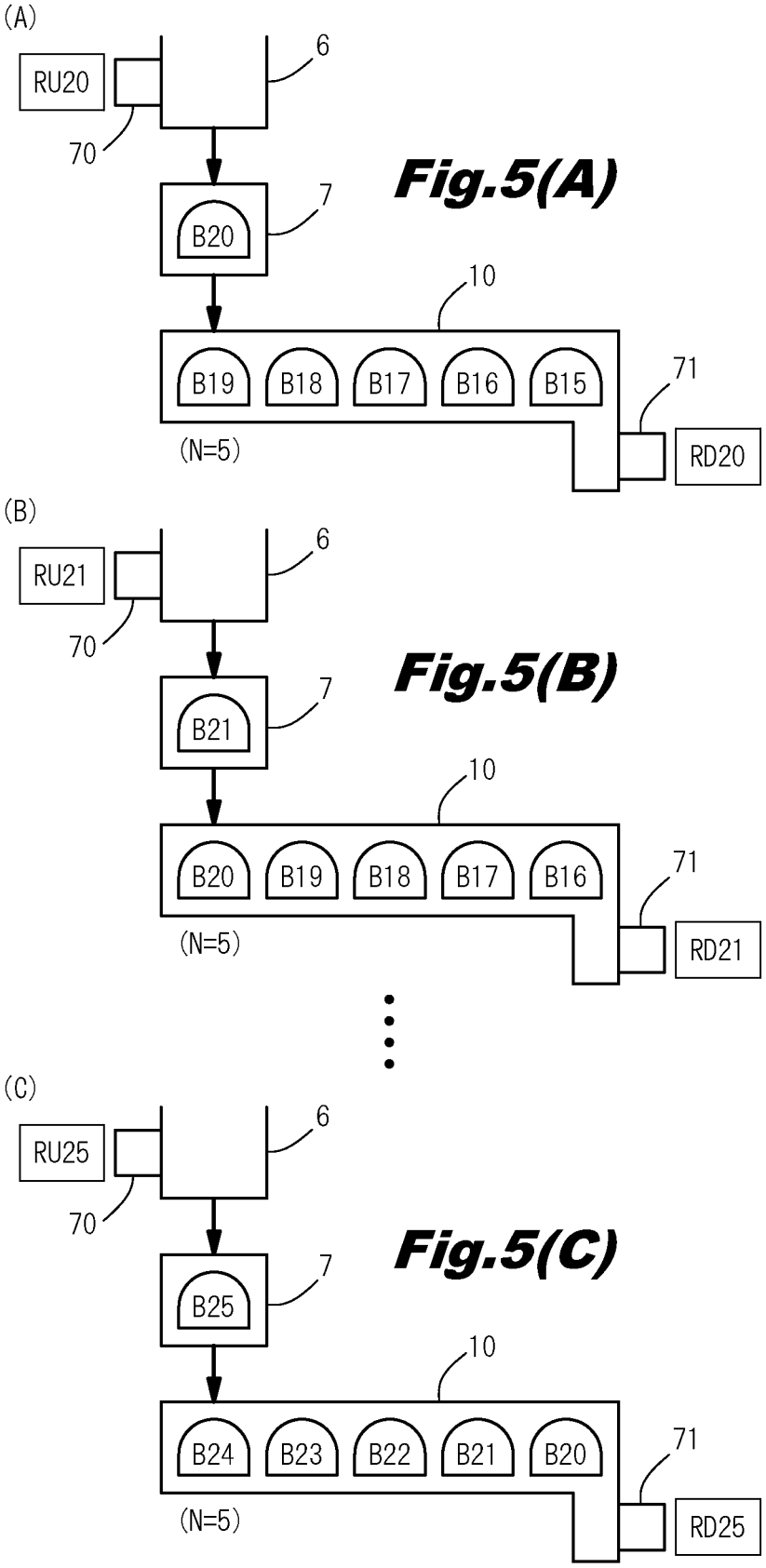
FIGS. 5(A) to (C) are schematic diagrams of the reclamation system for explaining the method of calculating the "average value of RD(n)", in which (A) shows a state of performing a polishing process of the 20th batch (n=20), (B) shows a state of performing a polishing process of the 21st batch (n=21), and (C) shows a state of performing a polishing process of the 25th batch (n=25).

FIG. 5(A) schematically shows the state of the reclamation system when the 20th batch-type polishing process (n=20) is performed by the polishing device 7. As shown in FIG. 5(A), the capacitance of the sand group of the recovered sand 1*a* in the 20th batch loaded into the polishing device 7 is measured in advance by the first measuring device 70, and the measurement result is defined as "RU20". Further, the measurement result by the second measuring device 71, which is executed at a predetermined timing according to the polishing process of the 20th batch by the polishing device 7, is defined as "RD20". As described above, since the value of N is set to "5" (N=5), the recovered sand 1*a* after the polishing process in an amount equivalent to a total of 5 batches of B19 to B15 is accommodated in the sorting device 10 in a state where the sand grain component 8 that becomes the reclamation sand 1*b* and the fine grain component 9 containing the binder are mixed.

FIG. 5(B) is a diagram schematically showing the state of the reclamation system when the 21st batch-type polishing process (n=21) is performed by the polishing device 7. As shown in FIG. 5(B), the capacitance of the sand group of the recovered sand 1*a* in the 21st batch loaded into the polishing device 7 is measured in advance by the first measuring device 70, and the measurement result can be indicated as "RU21". Further, the measurement result by the second measuring device 71, which is executed at a predetermined timing according to the polishing process of the 21st batch by the polishing device 7, can be indicated as "RD21". It is estimated that the sand group (B20) of the recovered sand in the 20th batch has already been loaded into the sorting device 10 from the polishing device 7, and the reclamation sand 1*b* delivered from the inside of the sorting device 10 via the sand discharge flow path 59 is not delivered by the first-in first-out method but is delivered regardless of the loading order (randomly) as described above. Thus, in the value of RD21 obtained by the second measuring device 71, the measurement result for the reclamation sand 1*b* from the sand group (B20) of the recovered sand 1*a* in the 20th batch is included.

FIG. 5(C) is a diagram schematically showing the state of the reclamation system when the 25th batch-type polishing process (n=25) is performed by the polishing device 7. As shown in FIG. 5(C), the capacitance of the sand group of the recovered sand 1*a* in the 25th batch loaded into the polishing device 7 is measured in advance by the first measuring device 70, and the measurement result can be indicated as "RU25". Further, the measurement result by the second measuring device 71, which is executed at a predetermined timing according to the polishing process of the 25th batch by the polishing device 7, can be indicated as "RD25". In the value of RD25, the measurement result for the reclamation sand 1*b* from the sand group (B20) of the recovered sand 1*a* in the 25th batch is included.

As described above, in the values of RD21 to RD25 by the second measuring device 71, the measurement result for the reclamation sand 1*b* from the recovered sand 1*a* of the sand group (B20) of the recovered sand 1*a* in the 20th batch that has been polished by the polishing device 7 is included. Therefore, in this embodiment, the average value of the measurement results of RD21 to RD25 is calculated as an "average value of RD20", and the average value is approximately recreated as the capacitance of the reclamation sand 1*b* generated by the 20th batch-type polishing process by the polishing device 7. Specifically, the "average value of RD20" is calculated by dividing the sum of (RD21+RD22+RD23+RD24+RD25) by "5" which is the N value.

Figure 6:
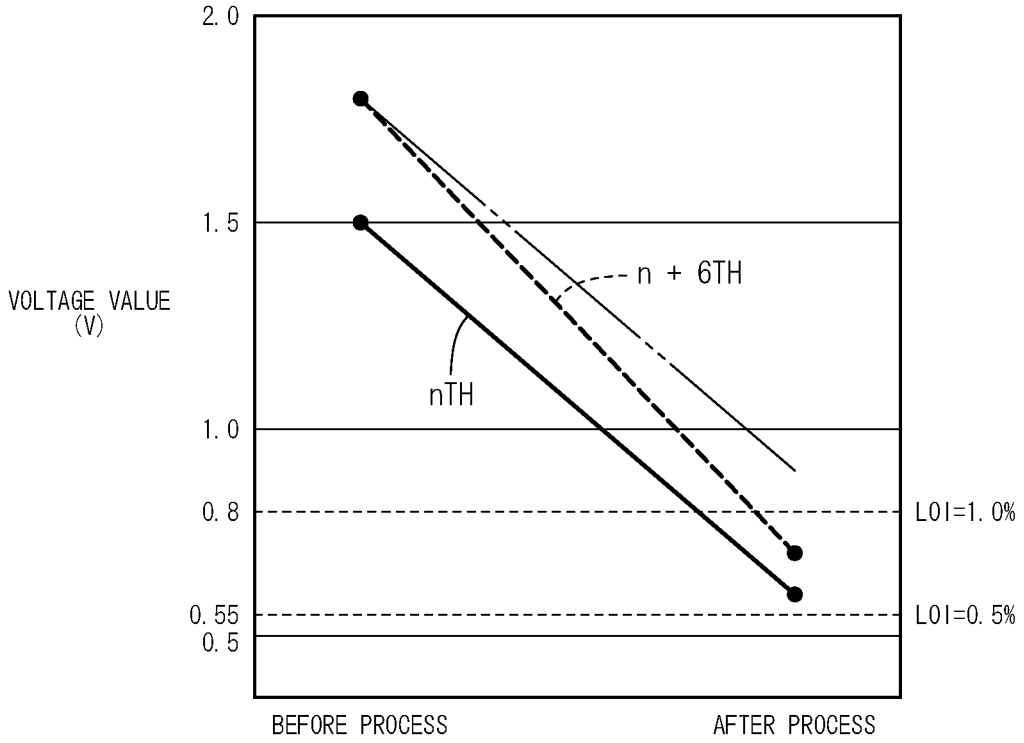
FIG. 6 is a diagram for explaining feedback control.

FIG. 6 is a diagram for explaining an example of specific feedback control by the arithmetic control unit using the above-mentioned "RU(n)" and "average value of RD(n)". Here, feedback control is performed so that a conversion value of the capacitance of the reclamation sand 1*b* after the reclamation process (after the polishing process and the sorting process) to the voltage (hereinafter, simply referred to as "voltage value") falls within a range of 0.55 V (LOI=0.5%) to 0.8 V (LOI=1.0%) as a target value. "LOI" is an abbreviation for "Loss of Ignition (Ignition loss of casting sand)". In the figure, the straight line indicated by the "nth" connects 1.5 V (RU(n)=1.5 V), which is the voltage value of the recovered sand 1*a* obtained by the first measuring device 70 before the nth batch process by the reclamation device 30, and 0.6 V (average value of RD(n)=0.6 V), which is the average value of the voltage value of the reclamation sand 1*b* obtained by the second measuring device 71 corresponding to the nth batch process. That is, the figure shows that the voltage value of the recovered sand 1*a* obtained by the first measuring device 70 before the nth batch process is 1.5 V, and the voltage value (average value of RD(n)) of the reclamation sand 1*b* obtained by the second measuring device 71 after the nth batch process is 0.6 V. As described above, since the N value in this embodiment is "5", the batch process in the next stage after the calculation of the average value of RD(n) is the n+6th batch process, and when the reclamation process condition in the n+6th batch process is set to the same as the reclamation process condition in the nth batch process, it can be estimated that the rate of change of the voltage value (slope of the line) in the n+6th batch process is the same as the rate of change of the voltage value (slope of the line) in the nth batch process. Therefore, for example, when the voltage value of the recovered sand 1*a* by the first measuring device 70 before the n+6th batch process is 1.8 V, the reclamation process is performed under the same conditions as the previous nth batch process. In that case, the voltage value of the reclamation sand 1*b* obtained by the second measuring device 71 after the batch process becomes 0.9 V (see the alternate long and two short dashes line in FIG. 4), and the voltage value may exceed the upper limit value of the target value, which is 0.55 V to 0.8 V. Therefore, the arithmetic control unit 82 performs feedback control so that the voltage value of the reclamation sand 1*b* after the n+6th batch process falls within the range of the target value.

As a specific example of the feedback control, it is conceivable to increase the rotation speed of the rotor 33, which can give a larger mutual polishing action to the recovered sand 1*a*. Thus, the surface of each recovered sand 1*a* can be more reliably polished, and the conversion value (voltage value) of the capacitance of the reclamation sand 1*b* after the batch process to the voltage can be further reduced. The broken line in FIG. 6 indicates the voltage value of the reclamation sand 1*b* measured by the second measuring device 71 in the n+6th batch process after the feedback control, where the rate of change of the voltage value is set larger than the rate of change of the voltage value in the nth batch process so that the voltage value after the batch process is 0.7 V, and the voltage value is kept within the range of the target value.

Figure 7:
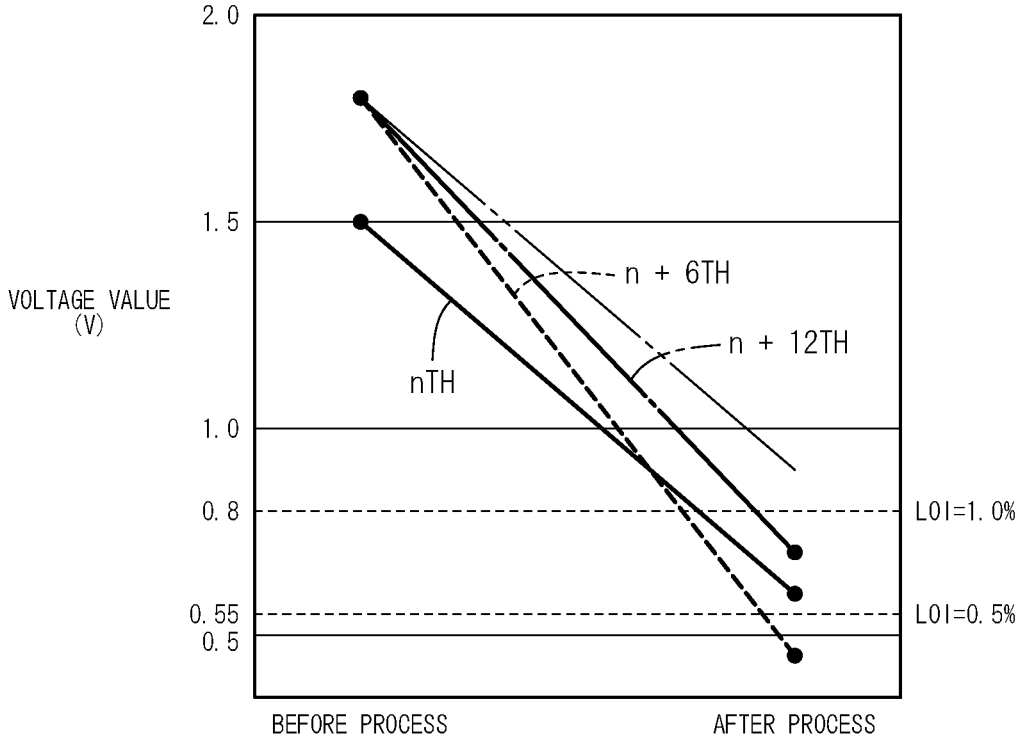
FIG. 7 is a diagram for explaining feedback control.

On the other hand, as indicated by the broken line in FIG. 7, when the rotation speed of the rotor 33 is increased in the n+6th batch process, the voltage value (average value) after the batch process may become lower than the lower limit value (0.55 V) of the target value. For example, when the voltage value of the recovered sand 1*a* by the first measuring device 70 before the n+12th batch process is 1.8 V, which is the same as the voltage value of the recovered sand 1*a* by the first measuring device 70 before the n+6th batch process, in the n+12th batch process, feedback control is performed so as to lower the rotation speed of the rotor 33 as compared with the n+6th batch process. The alternate long and short dash line in FIG. 7 shows the rate of change of the voltage value in the n+12th batch process. Here, feedback control is performed so as to lower the rotation speed of the rotor 33, so that the voltage value of the reclamation sand 1*b* after the batch process is kept within the range of the target value.

The small voltage value of the reclamation sand 1*b* after the reclamation process means that the binder was surely peeled off. However, at the same time, the recovered sand 1*a* is scraped too much, and the obtained reclamation sand 1*b* becomes finer, so that the reclamation yield may decrease. Therefore, it is desirable that the voltage value of the reclamation sand 1*b* after the reclamation process approaches the upper limit value (0.8 V) of the target value. According to the reclamation system of this embodiment, the reclamation process conditions are changed by feedback control so that the voltage value of the reclamation sand 1*b* after the reclamation process is brought closer to the upper limit value of the target value, and the decrease in the reclamation yield can be suppressed. To give a specific example, the solid line in FIG. 8 indicates the change of the voltage value before and after the nth batch process, where the voltage value before batch process is 1.5 V, and the voltage value (average value) after the batch process is 0.6 V, which is close to the lower limit value (0.55 V) of the target value. Then, when the voltage value before the n+6th batch process is 1.5 V, which is the same as the voltage value before the nth batch process, in the n+6th batch process, feedback control is performed so as to lower the rotation speed of the rotor 33 as compared with the nth batch process. The broken line in FIG. 8 indicates the rate of change of the voltage value in the n+6th batch process, where it is indicated that the voltage value after the batch process is 0.75 V, which is close to the upper limit value (0.8 V) of the target value. Thus, it is possible to prevent the reclamation sand 1*b* from becoming finer and the reclamation yield from decreasing.

However, the recovered sand 1*a* to be subjected to the reclamation process is diverse, such as mountain sand, natural silica sand, and artificial silica sand. The grain shape, grain size, hardness, etc. of the recovered sand 1*a* differ depending on the type, etc., and are not uniform. The binder adhering to the recovered sand 1*a* includes various types of binders such as inorganic, organic, acidic, and alkaline binders, and the ease of peeling differs. In view of these facts, it is difficult to keep the capacitance of the reclamation sand 1*b* after the reclamation process and the voltage value obtained by converting the capacitance within the ranges of the target values only by performing feedback control of changing the rotation speed of the rotor 33 as described above. Therefore, for example, when the recovered sand 1*a* having a low hardness is subjected to the reclamation process, it is conceivable to reduce the mutual polishing force acting on the recovered sand 1*a* by increasing the amount of the recovered sand 1*a* supplied to the polishing device 7 in one batch process, and lowering the rotation speed of the rotor 33. If the binder adhering to the recovered sand 1*a* is difficult to peel off, it is conceivable to perform feedback control of lengthening the polishing time in one batch process in the polishing device 7, or increasing the amount of the compressed air supplied from the blower 50.

More specifically, each element to be subject to the above feedback control acts so as to increase or decrease the rate of change in the capacitance of the casting sand before and after the reclamation process by changing each element so as to be increased or decreased. In general, to reduce the amount of the recovered sand 1*a* supplied by the supply control device 27 to the polishing device 7, to increase the rotation speed of the rotor 33 constituting the polishing device 7, to lengthen the polishing time by the polishing device 7, and to increase the amount of the compressed air supplied by the blower 50 constituting the sorting device 10 act so as to increase the rate of change in the capacitance. Conversely, to increase the amount of the recovered sand 1*a* supplied by the supply control device 27 to the polishing device 7, to lower the rotation speed of the rotor 33 constituting the polishing device 7, to shorten the polishing time by the polishing device 7, and to reduce the amount of the compressed air supplied by the blower 50 constituting the sorting device 10 act so as to decrease the rate of change in the capacitance.

Figure 8:
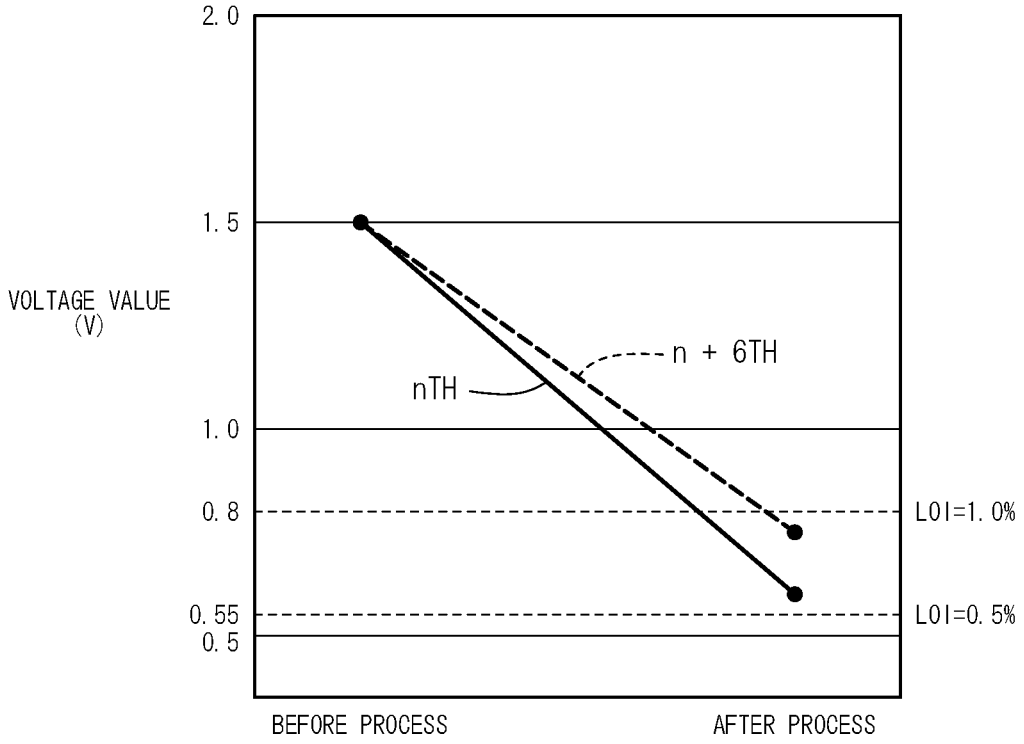
FIG. 8 is a diagram for explaining feedback control.
Figure 9:
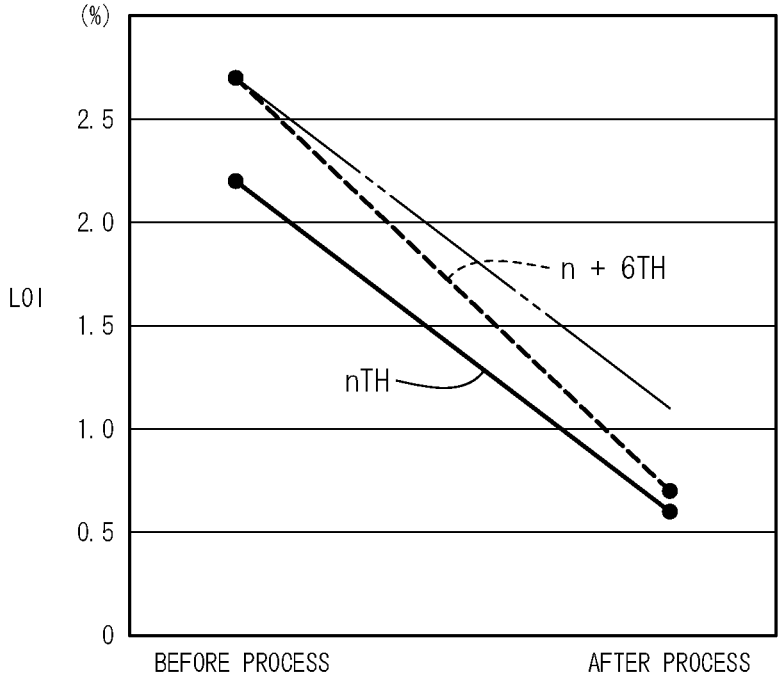
FIG. 9 is a diagram for explaining feedback control.
Figure 10:
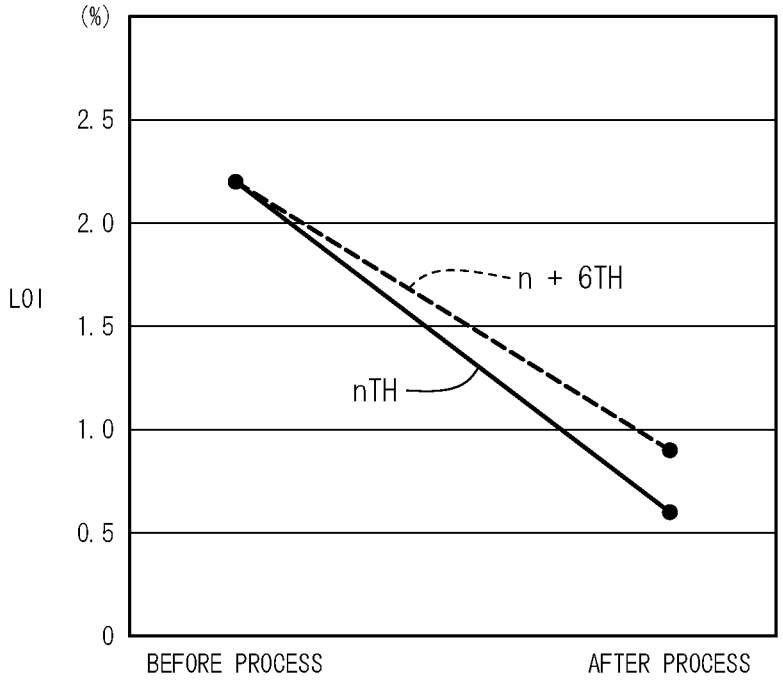
FIG. 10 is a diagram for explaining feedback control.

In FIGS. 6 to 8 above, feedback control is performed based on the rate of change of the conversion value (voltage value) of the capacitance of the casting sand before and after the reclamation process to the voltage by the converter. However, the feedback control may be performed based on the capacitance without performing the conversion to the voltage. The feedback control may be performed based on the LOI value converted from the capacitance. FIGS. 9 and 10 show feedback control based on the LOI value, and since the details are the same as those in FIGS. 6 and 8 above, the description thereof will be omitted.

As described above, in the reclamation system according to this embodiment, the average value "average value of RD(n)" of results of the measurement of a total of 5 times by the second measuring device 71, which is executed at a predetermined timing according to the (n+1)th to (n+5)th polishing processes by the polishing device 7, is calculated. Thus, it is possible to approximately obtain the capacitance of the reclamation sand 1*b* polished by the batch-type polishing device 7 and generated by each batch while employing the continuous-type sorting device 10. That is, in the reclamation system of this embodiment, under a state in which there is an extremely high possibility that the reclamation sand 1*b* obtained by the polishing process of each batch by the polishing device 7 remains in the sorting device 10, the average value of the measurement results by the second measuring device 71 is calculated by summing up the measurement results of many times (5 times) by the second measuring device 71, which are sent from the sorting device 10, and dividing the total value by the numerical value (5) related to the specific gravity sorting processing capacity value of the sorting device 10 compared with the polishing device 7. Thus, the capacitance of the reclamation sand 1*b* obtained by the polishing process of each batch by the polishing device 7 can be approximately recreated as the average value. From the above, according to this embodiment, the capacitance of the reclamation sand 1*b* can be approximately obtained by solving the following problem. Specifically, since the polishing device 7 is a batch type and the sorting device 10 is a continuous type, the correspondence between the recovered sand 1*a* loaded into the polishing device 7 and the reclamation sand 1*b* delivered from the sorting device 10 is unclear, with the result that the capacitance measurement for the reclamation sand 1*b* after the reclamation process becomes impossible.

In addition, in the reclamation system according to this embodiment, the measuring devices 70 and 71 that measure the capacitance of the casting sand 1 are arranged on the upstream side and the downstream side of the reclamation device 30, and based on the measurement results of the capacitances by these measuring devices 70 and 71, feedback control of changing any one or more elements selected from the amount of the recovered sand 1*a* supplied by the supply control device 27 to the polishing device 7, the rotation speed of the rotor 33 constituting the polishing device 7, the polishing time by the polishing device 7, and the amount of the compressed air supplied by the blower 50 constituting the sorting device 10 is performed. Thus, the properties of the casting sand 1, such as the amount of the binder adhering to the recovered sand 1*a* and the residual amount of the binder adhering to the reclamation sand 1*b* after the reclamation process are accurately grasped, and the reclamation process can be executed on the recovered sand 1*a* under more appropriate reclamation process conditions (polishing conditions and sorting conditions for the casting sand 1). From the above, it is possible to prevent poor polishing such as insufficient peeling of the binder and poor sorting such as insufficient separation of the reclamation sand 1*b* and the binder, so that the reclamation accuracy can be improved. In addition, it is possible to prevent the reclamation sand 1*b* from becoming finer due to excessive scraping of the recovered sand 1*a* during the polishing process, so that the reclamation yield can be improved.

Further, since the feedback control is performed based on the rate of change of the capacitance before and after the reclamation process, the capacitance of the reclamation sand 1*b* in the next stage process can be predicted, for example, based on the rate of change of the capacitance of the casting sand 1 before and after the process in the previous stage and the capacitance of the casting sand 1 before the process in the next stage process, and it is possible to change the reclamation process conditions so that the capacitance of the reclamation sand 1*b* in the next stage process becomes an optimum value. In addition, by changing the reclamation process conditions so that the capacitance of the reclamation sand 1*b* after the reclamation process in the next stage process approaches the upper limit value of the target value, it is possible to prevent the recovered sand 1*a* from being excessively scraped and becoming finer, so that it is possible to suppress a decrease in the reclamation yield.

The measuring devices 70 and 71 each include the extraction mechanism 72 that extracts part of the casting sand 1 flowing in the sand flow path 16 as a sample, the upstream branch flow path 73 that receives the casting sand 1 extracted by the extraction mechanism 72, and the measuring unit 74 that measures the capacitance of the predetermined amount of the casting sand 1 supplied from the upstream branch flow path 73. When a detection command is received, the extraction mechanism 72 is driven so that the predetermined amount of the casting sand 1 is extracted from the sand flow path 16 to the upstream branch flow path 73, and measurement operation for the capacitance of the casting sand 1 by the measuring unit 74 is performed. Thus, the detection operation for the capacitance of the casting sand 1 can be automated to automate the entire reclamation system including feedback control. Therefore, the reclamation process by the reclamation system can proceed quickly and speedily.

Since the measuring devices 70 and 71 each include the downstream branch flow path 75 that receives the casting sand 1 after the measurement by the measuring unit 74 and allows the casting sand 1 to flow through the sand flow path, so that the casting sand 1 can be allowed to flow through the sand flow path 16 via the downstream branch flow path 75 after the measurement by the measuring unit 74. As a result, the casting sand 1 extracted as a sample at the time of capacitance measurement is not discarded, and the extracted casting sand 1 can also be used as the reclamation sand 1*b*. From the above, since it is possible to prevent the casting sand 1 from decreasing by being extracted by the measuring devices 70 and 71, it is possible to suppress the decrease in the reclamation yield of the casting sand 1.

Figure 12:
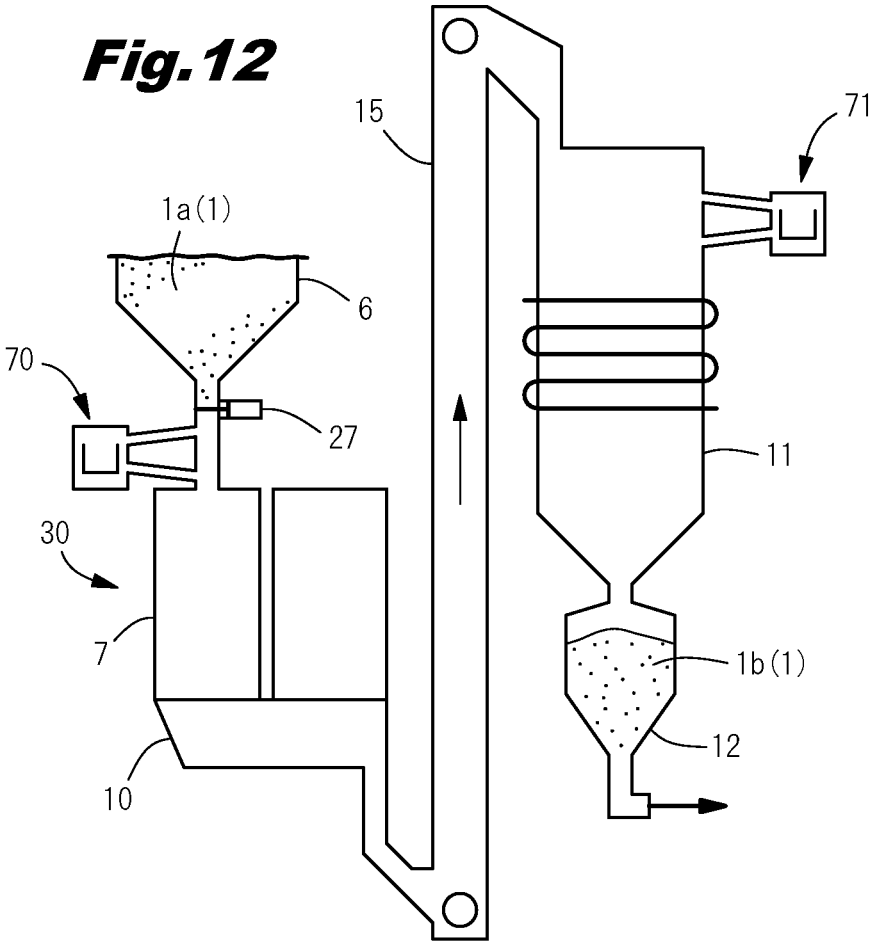
FIG. 12 is a schematic configuration diagram of a casting sand reclamation system according to a second embodiment of the present invention.

(Second embodiment) FIG. 12 shows a casting sand reclamation system according to a second embodiment of the present invention. The second embodiment is different from the previous first embodiment in that the second measuring device 71 is provided at the upper end of the sand cooler 11 to measure the capacitance of the reclamation sand 1*b* before cooling. Since the other points are the same as those in the first embodiment, the same members are designated by the same reference numerals and the description thereof will be omitted.

In the example of the above embodiment, the maximum specific gravity sorting processing capacity of the sorting device 10 is 5 times the maximum processing amount in one batch process by the polishing device 7, and N=5. However, the N value in the present invention is not limited to that listed in the first embodiment above, and may be 2 or more. The components of the reclamation system according to the present invention are not limited to those listed in the above embodiment.

REFERENCE SIGNS LIST

1 Casting sand
1*a* Recovered sand
1*b* Reclamation sand
6 Buffer device (buffer hopper)
7 Polishing device
8 Sand grain component
9 Fine grain component
10 Sorting device
16 Sand flow path
27 Supply control device
33 Rotating body (rotor)
34 Driving means (rotor motor)
50 Blower (blower means)
70 Capacitance measuring device (first measuring device)
71 Capacitance measuring device (second measuring device)
72 Extraction means (extraction mechanism)
73 Upstream branch flow path
74 Measuring unit
75 Downstream branch flow path
80 Control device

The invention claimed is:

1. A casting sand reclamation system that peels off a binder adhering to a surface of recovered sand to obtain reclamation sand, the casting sand reclamation system comprising:

a buffer device in which the recovered sand is stored;

a polishing device that includes a rotating body rotated by a driving means and peels off the binder adhering to the recovered sand by applying a mutual polishing action to the recovered sand;

a supply control device arranged between the buffer device and the polishing device to control a supply state of the recovered sand from the buffer device to the polishing device;

a sorting device that includes a blower means and sorts, by specific gravity, a sand grain group of the recovered sand supplied from the polishing device into a sand grain component that becomes the reclamation sand and a fine grain component containing the binder by supplying compressed air;

an upstream capacitance measuring device that is arranged on an upstream side of the polishing device and measures capacitance of the recovered sand;

a downstream capacitance measuring device that is arranged on a downstream side of the sorting device and measures capacitance of the reclamation sand as a sample; and a control device that performs, based on measurement results of the capacitances by these capacitance measuring devices and, feedback control of changing any one or more elements selected from an amount of the recovered sand supplied by the supply control device to the polishing device, a rotation speed of the rotating body constituting the polishing device, a polishing time by the polishing device, and an amount of the compressed air supplied by the blower means constituting the sorting device, wherein the polishing device is a batch-type device that intermittently processes the recovered sand of a predetermined processing amount sent from the buffer device, wherein the sorting device is a continuous-type device having a specific gravity sorting processing capacity for the recovered sand, which is N times an amount of one processing by the batch-type polishing device, wherein the downstream capacitance measuring device measures the capacitance of the reclamation sand supplied from the sorting device as a sample at a predetermined timing according to supply operation of the recovered sand from the buffer device to the polishing device, and wherein, when a measurement result by the upstream capacitance measuring device, which is performed prior to an (n)th batch-type polishing process by the polishing device, is represented by "RU(n)", a measurement result by the downstream capacitance measuring result, which is executed at a predetermined timing according to the (n)th polishing process by the polishing device, is represented by "RD(n)", a measurement result by the downstream capacitance measuring result, which is executed at a predetermined timing according to an (n+1)th polishing process by the polishing device, is represented by "RD(n+1)", and a measurement result by the downstream capacitance measuring result, which is executed at a predetermined timing according to an (n+b)th polishing process by the polishing device, is represented by "RD(n+=b)", the control device performs feedback control based on comparison between a value of "RU(n)" and an "average value of RU(n)" calculated by {"RD(n+1)"+"RD (n+2)"+ . . . "RD(n+N)" }/N.

2. The casting sand reclamation system according to claim 1, wherein the control device calculates a rate of change of the capacitance before and after a reclamation process based on the value of "RU(n)" and the "average value of RD(n)", and performs feedback control based on the rate of change.

3. The casting sand reclamation system according to claim 1, wherein the casting sand reclamation system includes a sand flow path through which a casting sand flows, and the buffer device, the polishing device, and the sorting device are arranged on the sand flow path in the stated order, wherein the upstream capacitance measuring device and the downstream capacitance measuring device each include an extraction means that extracts part of the casting sand flowing in the sand flow path as a sample, an upstream branch flow path that receives the casting sand extracted by the extraction means, and a measuring unit that measures capacitance of a predetermined amount of the casting sand supplied from the upstream branch flow path, and wherein, when a detection command from the control device is received, the extraction means is driven so that a predetermined amount of the casting sand is extracted from the sand flow path to the upstream branch flow path, and measurement operation for the capacitance of the casting sand by the measuring unit is performed.

4. The casting sand reclamation system according to claim 3, wherein the upstream capacitance measuring device and the downstream capacitance measuring device each include a downstream branch flow path that receives the casting sand after the measurement by the measuring unit and allows the casting sand to flow through the sand flow path.

5. A casting sand reclamation method of peeling off a binder adhering to a surface of recovered sand to obtain reclamation sand, the casting sand reclamation method comprising:

a first capacitance measurement step of measuring capacitance of the recovered sand as a sample prior to a polishing process;

a polishing step of performing a polishing process of peeling off the binder adhering to the recovered sand by applying a mutual polishing action to a predetermined amount of the recovered sand using a batch-type polishing device;

a sorting step of performing a process of sorting, by specific gravity, a sand grain group of the recovered sand supplied from the polishing device into a sand grain component that becomes the reclamation sand and a fine grain component containing the binder by supplying compressed air using a sorting device including a blower means;

a second capacitance measurement step of measuring capacitance of the reclamation sand after the sorting as a sample; and a feedback step of changing any one or more elements selected from an amount of the recovered sand supplied by the polishing device responsible for the polishing process, a rotation speed of a rotating body constituting the polishing device, a polishing time by the polishing device, and an amount of the compressed air supplied by the blower means constituting the sorting device responsible for the specific gravity sorting process, based on a measurement value in the first capacitance measurement step and a measurement value in the second capacitance measurement step, wherein the sorting device is a continuous-type device having a specific gravity sorting processing capacity for the recovered sand, which is N times one processing amount by the batch-type polishing device, wherein, in the second capacitance measurement step, the capacitance of the reclamation sand supplied from the sorting device is measured as a sample at a predetermined timing according to supply operation of the recovered sand to the polishing device, and wherein, when a measurement result in the first capacitance measurement step, which is performed prior to an (n)th batch-type polishing process by the polishing device, is represented by "RU(n)", a measurement result in the second capacitance measurement step, which is executed at a predetermined timing according to the (n)th polishing process by the polishing device, is represented by "RD(n)", a measurement result in the second capacitance measurement step, which is executed at a predetermined timing according to an (n+1)th polishing process by the polishing device, is represented by "RD(n+1)", and a measurement result in the second capacitance measurement step, which is executed at a predetermined timing according to an (n+b)th polishing process by the polishing device, is represented by "RD(n+b)", in the feedback step, feedback control is performed based on comparison between a value of "RU(n)" and an "average value of RU(n)" calculated by {"RD(n+1)"+"RD(n+2)"+ . . . "RD(n+N)"}N.

6. The casting sand reclamation method according to claim 5, wherein, in the feedback step, a rate of change of the capacitance before and after a reclamation process is calculated based on the value of "RU(n)" and the "average value of RD(n)", and feedback control is performed based on the rate of change.

7. The casting sand reclamation system according to claim 2, wherein the casting sand reclamation system includes a sand flow path through which a casting sand flows, and the buffer device, the polishing device, and the sorting device are arranged on the sand flow path in the stated order, wherein the upstream capacitance measuring device and the downstream capacitance measuring device each include an extraction means that extracts part of the casting sand flowing in the sand flow path as a sample, an upstream branch flow path that receives the casting sand extracted by the extraction means, and a measuring unit that measures capacitance of a predetermined amount of the casting sand supplied from the upstream branch flow path, and wherein, when a detection command from the control device is received, the extraction means is driven so that a predetermined amount of the casting sand is extracted from the sand flow path to the upstream branch flow path, and measurement operation for the capacitance of the casting sand by the measuring unit is performed.

8. The casting sand reclamation system according to claim 7, wherein the upstream capacitance measuring device and the downstream capacitance measuring device each include a downstream branch flow path that receives the casting sand after the measurement by the measuring unit and allows the casting sand to flow through the sand flow path.

* * * * *